US005587621A

United States Patent [19]

Colditz

[11] Patent Number: 5,587,621

[45] Date of Patent: Dec. 24, 1996

[54] IMAGE INTENSIFIER TUBE

[75] Inventor: Johannes K. E. Colditz, Heerlen, Netherlands

[73] Assignee: U.S. Philips Corporation, New York, N.Y.

[21] Appl. No.: 385,520

[22] Filed: Feb. 8, 1995

[30] Foreign Application Priority Data

Feb. 9, 1994 [BE] Belgium ..... 9400152

[51] Int. Cl.[6] ..... H01J 29/45

[52] U.S. Cl. ..... 313/366; 313/386; 313/530; 313/527; 313/541; 313/543

[58] Field of Search ..... 313/366, 368, 313/367, 373, 375, 386, 530, 527, 541, 542, 543, 544

[56] References Cited

U.S. PATENT DOCUMENTS

| | | | |
|---|---|---|---|
| 2,525,832 | 10/1950 | Sheldon | 313/527 X |
| 3,800,194 | 3/1974 | Maruyama et al. | 313/366 X |
| 3,904,911 | 9/1975 | Welsch | 313/366 |
| 4,002,938 | 1/1977 | Pehe | 313/527 |
| 4,626,885 | 12/1986 | Ishioka et al. | 313/366 X |
| 4,816,715 | 3/1989 | Unnai et al. | 313/366 |
| 4,952,839 | 8/1990 | Tanioka et al. | 313/366 |

FOREIGN PATENT DOCUMENTS 01089131 3/1989 Japan .

*Primary Examiner*—Sandra L. O'Shea
*Assistant Examiner*—Ashok Patel
*Attorney, Agent, or Firm*—Jack D. Slobod

[57] ABSTRACT

In order to increase the sensitivity of an image intensifier tube, the efficiency with which an electron image is formed from radiation of a first wavelength is increased. Radiation of the first wavelength is converted into radiation of a second wavelength by means of a conversion screen provided with a scintillation layer, and radiation of the second wavelength releases electrons from a photocathode which is sensitive to the second wavelength. Loss of radiation of a second wavelength, incurred because a part of this radiation does not reach the photocathode, is reduced. Radiation of the second wavelength which is not emitted in the direction of the photocathode is recaptured by providing the conversion screen with a metallic reflecting intermediate layer.

8 Claims, 1 Drawing Sheet

IMAGE INTENSIFIER TUBE

BACKGROUND OF THE INVENTION

1. Field of the Invention

The invention relates to an image intensifier tube, comprising a conversion screen with a substrate on which there is provided a seed layer which is separated by an intermediate layer from a scintillation layer for converting incident radiation of a first wavelength into radiation of a second wavelength. Such an image intensifier tube is used inter alia in an X-ray examination apparatus in order to convert an X-ray image into a light image and to increase the brightness thereof.

2. Description of the Related Arts

An image intensifier tube of this kind is known from Japanese Patent Application JP 62-245471 (publication No. 64-89131).

The known image intensifier tube comprises an entrance section with a conversion screen which comprises a substrate, for example in the form of an aluminium foil. On the substrate there is provided a seed layer which consists of crystalline particles of an akalihalide material, for example caesium iodide (CsI), having a thickness of 15 μm or less. On the seed layer there is provided a thin intermediate layer of a metal or metal oxide, preferably aluminium, which has a thickness of between 10 nm and 300 nm, preferably approximately 100 nm, and which follows the shape of the crystalline particles of the seed layer. On the intermediate layer there is vapour deposited a scintillation layer which has a thickness of from approximately 250 to 450 μm and consists of columnar crystals of a fluorescent alkalihalide, such as sodium-doped caesium iodide (CsI:Na). The crystalline particles of the seed layer, covered by the aluminium of the intermediate layer, act as nuclei for the formation of the scintillation layer with columnar crystals. These columnar crystals provide a light guiding effect for the light of the second wavelength which is produced by absorption of incident radiation of the first wavelength in the scintillation layer.

The intermediate layer of the known image intensifier tube is formed by vapour deposition of a metal or a metal oxide in an inert gas atmosphere, for example a xenon atmosphere. Such a vapour deposition method produces an intermediate layer of a powdery material. The intermediate layer in the known image intensifier tube is constructed as a layer which consists of one or more metals or metal oxides and is conceived so that the intermediate layer absorbs radiation of the second wavelength, notably light, produced in the conversion screen. Consequently, a part of the light produced in the conversion screen is lost to the formation of the electron image by the photocathode and the sensitivity of the known X-ray image intensifier tube for the conversion of incident radiation is degraded.

SUMMARY OF THE INVENTION

It is inter alia an object of the invention to provide an image intensifier tube exhibiting an enhanced sensitivity for the conversion of incident radiation.

In order to achieve this object, an image intensifier tube according to the invention is characterized in that the intermediate layer is reflective for at least a part of radiation of the second wavelength emitted towards the intermediate layer.

The image intensifier tube forms a radiation image on the conversion screen and converts it into a light image of increased brightness on the exit section in which a phosphor layer is provided. The conversion screen comprises a scintillation layer which contains an alkalihalide which is sensitive to incident X-rays, for example sodium-doped caesium iodide (CsI:Na). Image-carrying radiation of the first wavelength which is incident on the conversion screen of the image intensifier tube, for example X-rays, is converted into radiation of the second wavelength in the scintillation layer, for example blue light or ultraviolet radiation whereto the photocathode is sensitive. The absorption of the radiation of the second wavelength releases electrons from the photocathode material, which electrons form an electron image which is imaged on the phosphor layer by the electron-optical system. The phosphor layer converts the electron image into a light image which can be picked up from an exit section by an image detector and whose brightness has been increased relative to the brightness of the radiation image on the entrance section.

Because the intermediate layer of the conversion screen reflects radiation of the second wavelength, it is achieved that radiation of the second wavelength which is emitted in the direction away from the photocathode, i.e. in the direction of the intermediate layer, is not lost to the releasing of electrons in the photocathode which form the electron image. The intermediate layer reflects radiation of the second wavelength so that it reaches the photocathode as yet so as to release electrons from the photocathode material. Consequently, radiation of the second wavelength, for example blue light or ultraviolet radiation, formed in the scintillation layer from radiation of the first wavelength, for example X-rays, is more efficiently used in forming the electron image.

Assuming a given amount of incident radiation of the first wavelength, the amount of electrons formed from said amount of radiation by an image intensifier tube in accordance with the invention is greater than that in a conventional image intensifier tube. In comparison with a conventional image intensifier tube, the image intensifier tube in accordance with the invention requires a smaller amount of radiation of the first wavelength in order to present the same light intensity to the exit section. When the image intensifier tube is used as an X-ray image intensifier tube in an X-ray examination apparatus, an image intensifier tube according to the invention offers the advantage that the X-ray dose whereto a patient to be examined must be exposed is reduced.

A preferred embodiment of an image intensifier tube according to the invention is characterized in that the intermediate layer is a metallic layer and follows the thickness variation of the seed layer due to the granular structure of the seed layer. The seed layer contains crystalline grains of an alkalihalide, for example caesium iodide. These grains of crystalline material constitute a granular structure and act as suitable nuclei for the growth of columnar caesium iodide crystals of the scintillation layer. Because according to the invention the intermediate layer is a metallic layer having an electric surface conductivity, it is reflective for the radiation of the second wavelength. Furthermore, the intermediate layer is constructed so that it follows the granular structure of the seed layer. The side of the intermediate layer which faces the scintillation layer, therefore, exhibits the spatial structure of the seed layer to a substantial degree. On such a structure an alkalihalide, such as sodium-doped caesium iodide, grows preferably in the form of columnar crystals which, via total reflection at the boundaries between the columnar crystals, guide light of the second wavelength which is produced in the scintillation layer by absorption of light of the first wavelength, for example X-rays. This guiding of light counteracts scattering of light of the second wavelength in directions transversely of the direction of the longitudinal axis of the columnar crystals and enhances the spatial resolution of an image intensifier tube according to the invention.

A further preferred embodiment of an image intensifier tube according to the invention is characterized in that the local thickness of the intermediate layer amounts to no more than a fraction of the local difference in thickness in the seed layer due to the granular structure of the seed layer.

The spatial structure of the side of the seed layer which is remote from the substrate is followed to a substantial degree by the intermediate layer when the intermediate layer is constructed so as to be sufficiently thin. The intermediate layer is preferably so thin that the thickness of the intermediate layer is substantially smaller than the difference between the thickness of the seed layer at the area of a peak of a grain of crystalline alkalihalide material of the seed layer and that at the area of a valley between two adjacent grains of crystalline material of the seed layer.

A further preferred embodiment of an image intensifier tube according to the invention is characterized in that the thickness of the intermediate layer amounts to no more than 100 nm.

A seed layer containing grains of a crystalline material exhibits a difference in thickness between the peak of such a grain and a valley between two adjacent grains which typically has a value of between approximately 1 μm and approximately 5 μm. Because the thickness of the intermediate layer preferably amounts to only a fraction of said difference in thickness, the thickness of the intermediate layer preferably amounts to no more than 100 nm.

A further preferred embodiment of an image intensifier tube according to the invention is characterized in that the intermediate layer consists of at least one of the metals from the group formed by aluminium, chromium, nickel and iron.

For use as an X-ray image intensifier tube, the image intensifier tube according to the invention preferably comprises a scintillation layer containing caesium iodide (CsI) doped with sodium (Cs:Na) or thallium (Cs:Tl). Suitable materials for forming a reflective metallic intermediate layer on a seed layer of mainly caesium iodide for use in an image intensifier tube according to the invention are metals from the group formed by aluminium, chromium, nickel and iron. Alloys of different metals from this group are also suitable for use in a metallic reflective intermediate layer of an image intensifier tube according to the invention.

Some embodiments of the invention will be described in detail hereinafter, by way of example, with reference to the accompanying drawings; therein:

DETAILED DESCRIPTION OF THE PREFERRED EMBODIMENTS

Figure 1:
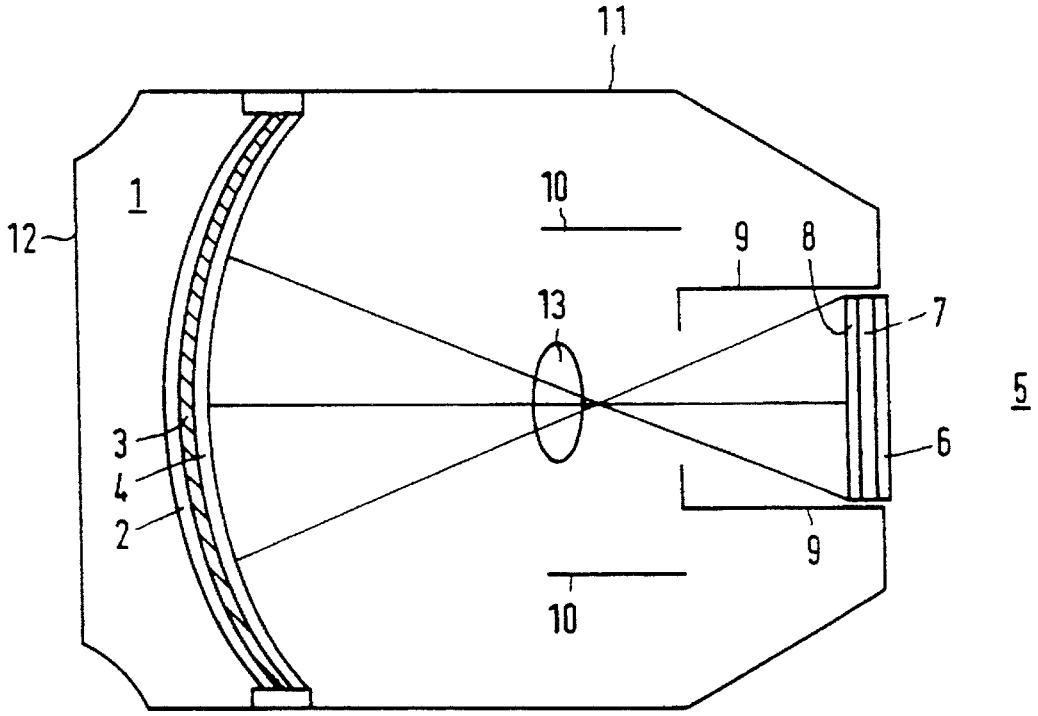
FIG. 1 is a sectional view of an image intensifier tube according to the invention.

FIG. 1 is a sectional view of an image intensifier tube according to with the invention. The image intensifier tube comprises an entrance section 1 provided with a metal foil 2 which serves as a substrate for a conversion screen 3 on which there is provided a photocathode 4. In order to realize an image intensifier tube which operates as an X-ray image intensifier, the conversion screen preferably contains Na-doped caesium iodide CsI (CsI:Na), the metal foil being an aluminium foil and the photocathode consisting of antimony saturated with an alkali metal. The image intensifier tube also comprises an exit section 5 with an exit window 6 whose side which faces the interior of the image intensifier tube is provided with a phosphor layer 7. An electron optical system is formed by the photocathode 4, a cylindrically symmetrical anode 9, an annular electrode 10 and an end anode 8 which is provided on the phosphor layer 7. All above components are accommodated in a vacuum envelope which is formed by a cylindrical sleeve 11, an entrance window 12 and the exit window 6. Image carrying radiation, for example X-rays, incident on the entrance section 1 forms a radiation image on the conversion screen 3. The CsI:Na converts X-rays mainly into blue light and/or ultraviolet light of a wavelength whereto the photocathode material is sensitive. The light emitted to the photocathode 4 by the conversion screen 3 is converted into electrons by the photocathode whereto a negative voltage is applied. A positive high voltage is applied to the hollow anode 9, so that the electron-optical system images an image-carrying electron beam 13 on the phosphor layer 7. Electrons of the image-carrying electron beam are incident on the phosphor layer 7 which converts the image carried by the electron beam into a light-optical image on the exit window.

Figure 2:
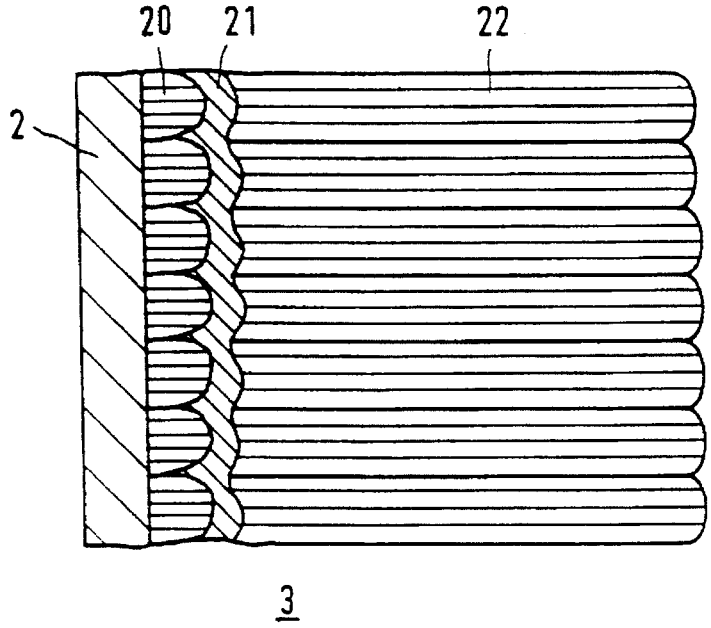
FIG. 2 is a sectional view of a part of the entrance section of an image intensifier tube according to the invention.

FIG. 2 is a sectional view of a part of the entrance section of an image intensifier tube according to the invention. FIG. 2 shows notably the metal foil 2 on whose side which faces the exit section 5 of the image intensifier tube there is provided a seed layer 20 having a granular structure of caesium iodide of a thickness of between 5 μm and 50 μm. An intermediate layer 21, consisting of a metal such as aluminium, is vapour deposited on the seed layer. On the side of the intermediate layer 21 which is remote from the metal foil there is provided a scintillation layer 22 of a thickness of some hundreds of μm which contains columnar CsI:Na crystals, the longitudinal axis of the columns extending transversely of the scintillation layer. The seed layer 20, the intermediate layer 21 and the scintillation layer 22 together constitute the conversion screen 3. The combination of the seed layer 20 and the intermediate layer 21 creates conditions in which CsI:Na can be readily provided on the metal layer so that it has the desired columnar structure. The seed layer is formed by a granular structure of grains of caesium iodide doped with sodium or not. The intermediate layer is so thin that it follows the structure of the-surface of the seed layer which is remote from the substrate. The structure of this surface of the seed layer is formed in that the seed layer has a granular structure which has a thickness between adjacent grains on the surface of the seed layer which is locally slightly smaller than the thickness of the seed layer at the area of the centre of a grain on the surface of the seed layer. Because the thickness of the intermediate layer is smaller than the local thickness differences in the seed layer, the intermediate layer takes over the spatial structure of the seed layer, and the side of the intermediate layer which faces the scintillation layer is structured so that the caesium iodide crystals of the scintillation layer grow on said intermediate layer preferably in the form of columnar crystals when the caesium iodide is vapour deposited on the intermediate layer.

The incident image-carrying radiation, for example X-rays, is converted in the scintillation layer 22 so as to form electromagnetic radiation of a wavelength in the range of blue light and/or ultraviolet light whereto the photocathode 4 is sensitive. In an image intensifier tube according to the invention the intermediate layer 21 is constructed as a metallic reflecting intermediate layer, i.e. the radiation produced in the scintillation layer and emitted in the direction of the metallic reflecting intermediate layer 21 is substantially reflected in the direction of the photocathode by said metallic layer. Consequently, the fraction of the light produced in the scintillation layer whereto the photocathode is sensitive and which indeed reaches the photocathode is greater than in a conventional image intensifier tube.

The scintillation layer preferably is formed so as to consist of columnar crystals in order to achieve that the light of the second wavelength, formed by conversion, and the light reflected by the intermediate layer are subject to a light guiding effect, so that light emerges in the direction of the photocathode and more or less perpendicularly from the conversion screen, so that image veiling is substantially mitigated.

The reflective effect of the metallic reflecting intermediate layer 21 is preferably achieved by vapour deposition of this metal layer on the seed layer in vacuum. The metal layer is then formed on the seed layer so as to have a light-reflecting surface facing the scintillation layer.

I claim:

1. An image intensifier tube, comprising a conversion screen with a substrate on which there is provided a seed layer which is separated by an intermediate layer from a scintillation layer for converting incident radiation of a first wavelength into radiation of a second wavelength, characterized in that the intermediate layer is reflective for at least a part of radiation of the second wavelength emitted towards the intermediate layer.

2. An image intensifier tube as claimed in claim 1, characterized in that the seed layer has a granular structure and the intermediate layer is a metallic layer which follows a thickness variation of the seed layer due to the granular structure of the seed layer.

3. An image intensifier tube as claimed in claim 2, characterized in that a thickness of the intermediate layer amounts to no more than a fraction of a local difference in thickness in the seed layer due to the granular structure of the seed layer.

4. An image intensifier tube as claimed in claim 3, characterized in that the thickness of the intermediate layer amounts to no more than 100 nm.

5. An image intensifier tube as claimed in claim 1, characterized in that the intermediate layer consists of at least one metal selected from the group consisting of aluminum, chromium, nickel and iron.

6. An image intensifier tube as claimed in claim 2, characterized in that the intermediate layer consists of at least one metal selected from the group consisting of aluminum, chromium, nickel and iron.

7. An image intensifier tube as claimed in claim 3, characterized in that the intermediate layer consists of at least one metal selected from the group consisting of aluminum, chromium, nickel and iron.

8. An image intensifier tube as claimed in claim 4, characterized in that the intermediate layer consists of at least one metal selected from the group consisting of aluminum, chromium, nickel and iron.

* * * * *